United States Patent [19]

Lundberg

[11] Patent Number: 4,512,776

[45] Date of Patent: Apr. 23, 1985

[54] IONIC POLYMER-POLYLACTONE COMPOSITIONS AS FLOW IMPROVERS FOR OILS AND FUELS

[75] Inventor: Robert D. Lundberg, Bridgewater, N.J.

[73] Assignee: Exxon Research and Engineering Co., Florham Park, N.J.

[21] Appl. No.: 565,188

[22] Filed: Dec. 23, 1983

[51] Int. Cl.[3] ..... C10L 1/24

[52] U.S. Cl. ..... 44/62; 44/71

[58] Field of Search ..... 44/62, 71; 525/331.8, 525/186, 190

[56] References Cited

U.S. PATENT DOCUMENTS

| | | | |
|---|---|---|---|
| 3,642,728 | 2/1972 | Canter | 525/341 |
| 3,836,511 | 9/1974 | O'Farrell et al. | 525/344 |
| 3,974,241 | 8/1976 | Lundberg et al. | 525/186 |
| 4,131,586 | 12/1978 | Makowski et al. | 525/331.8 |
| 4,379,914 | 4/1983 | Lundberg | 528/354 |
| 4,421,898 | 12/1983 | Lundberg et al. | 525/190 |

*Primary Examiner*—Y. Harris-Smith

*Attorney, Agent, or Firm*—Richard E. Nanfeldt

[57] ABSTRACT

A family of polymers based on amine terminated polylactones is interacted with a carboxylic or sulfonic acid or ionomer derived therefrom to create a complex or neutralized species. The resulting adduct is useful as a pour depressant agent which is very effective in promoting flow of heating fuels, diesel, and paraffinic oils at extremely low temperatures.

38 Claims, No Drawings

IONIC POLYMER-POLYLACTONE COMPOSITIONS AS FLOW IMPROVERS FOR OILS AND FUELS

FIELD OF THE INVENTION

This invention relates to unique and novel pour depressant agents for middle distillate and lighter oils, wherein the pour depressant agents are based on chemically combining a sulfonated polymer and a tertiary amine terminated polylactone composition which results in an amine neutralized sulfonated polymer or a complex of said amine polymer with a neutralized sulfonated polymer.

BACKGROUND OF THE INVENTION

Recently, a new class of thermoelastic sulfonated polymers has been described in a number of U.S. Patents. These sulfonated polymers are derived from polymeric materials having olefinic unsaturation, especially elastomeric polymers such as Butyl and EPDM rubbers. U.S. Pat. No. 3,642,728, herein incorporated by reference, clearly teaches a method of selective sulfonation of olefinic unsaturation sites of an elastomeric polymer to form an acid form of a sulfonated elastomeric polymer. The olefinic sites of the elastomeric polymer are sulfonated by means of a complex of a sulfur trioxide donor and a Lewis base. The $SO_3H$ groups of the sulfonated elastomer can be readily neutralized with a basic material to form an ionically cross-linked elastomer at room temperature. However, these ionically cross-linked elastomers may be processed like a conventional thermoplastic at elevated temperatures under a shear force in the presence of selected preferential plasticizers, which dissipate the ionic associations at the elevated temperatures, thereby creating a reprocessable elastomer.

The basic materials used as neutralizing agents are selected from organic amines or basic materials selected from Groups I, II, III, IV, V, VI-B and VIII, and mixtures thereof, of the Periodic Table of Elements.

U.S. Pat. No. 3,836,511, herein incorporated by reference, teaches an improved process for the sulfonation of the olefinic sites of the elastomeric polymer, wherein the improved sulfonating agent is selected from acetyl sulfate, propionyl sulfate and butyryl sulfate. The neutralizing agents employed to neutralize the acid form of the sulfonated elastomeric polymers are organic amines.

This class of sulfonated polymers is especially interesting because at low levels of sulfonate groups, the polymers are readily soluble in a variety of hydrocarbon fluids, such as oils, jet fuel, gasoline and the like, provided that the polymer backbone is suitably soluble in such fluids. For example, EPDM, or ethylene-propylene-diene monomer terpolymer is soluble in oil. The sulfonated version of this polymer, Sulfo-EPDM is also soluble in oils at low sulfonate content, however, at higher sulfonate content the aggregation of the ionic groups can lead to a gel phase of the ionic polymer. The instant invention is based on the concept that an amine terminated poly $\epsilon$-caprolactone can interact with the associated ionic groups and thereby create a more soluble species: a polymer complex of the sulfonated polymer and the polycaprolactone. This complex (or acid-base adduct if the amine is interacted with the polymer sulfonic acid) can now be soluble in a variety of hydrocarbon fluids and due to the specific structures of these systems, we find they are very effective in inhibiting the tendency of certain paraffinic fluids to solidify at low temperatures. Thus, these systems are good flow modifiers.

With the increase in the use of hydrocarbon fuels of all kinds, a serious problem has arisen in areas frequently subjected to low temperatures in the cold test characteristics with heating oils and diesel and jet fuels that have too high a pour point, resulting either in distributional or operating difficulties or both. For example, the distribution of heating oils by pumping or syphoning is rendered difficult or impossible at temperatures around or below the pour point of the oil. Furthermore, the flow of the oil at such temperatures through the filters cannot be maintained, leading to the failure of the equipment to operate.

Also the low temperature properties of petroleum distillate fuels boiling in the range between about 140° C. and about 400° C. have attracted increasing attention in recent years because of the growth of a market for such fuels in subarctic areas and because of the development of turbo-jet aircraft capable of operating at altitudes where temperatures of −50° C. or lower may be encountered.

It is, of course, well known to add pour depressants to lubricating oils to lower the pour point. These lube oil additives, mostly high molecular weight organic compositions formed by alkylation of benzene or naphthalene or derivatives thereof, or by polymerization of lower molecular weight methacrylates, or by condensation polymerization of various kinds, are not satisfactory in service with middle distillate and lighter fuels.

A wide variety of compounds have been found to be effective as pour point depressants for lubricating oil. Among the best known are "Paraflow", "Santopour", and "Acryloid" and their modifications. They are prepared either by condensing aromatic compounds with long chain paraffins, such as wax, or by condensing olefinic esters. It is generally considered that these pour depressants are effective in that upon cooling an additive containing oil, the hydrocarbon chain of the additive becomes incorporated into the crystal lattice of the separated wax, while the other part of the pour depressant molecule prevents the crystals from adhering together to form a gel structure. The failure of these additives to be effective in middle distillates may at least in part be due to the basic difference in the composition between the wax in lubricating oils and that in middle distillate fuels.

The concept of this invention is the use of hydrocarbon soluble or dispersible polymers based on polycaprolactone (PCL) as pour point depressants and middle distillate flow improvers. Specifically these polymers are prepared by polymerization of -caprolactone initiated by a suitable diamine (of U.S. Pat. No. 4,379,914). The resultant lactone polymers are not typically soluble in paraffinic hydrocarbons. We have found that soluble systems comprising these polymers can be prepared in several ways:

(1) Neutralization of a polymer sulfonic acid with the amine terminated PCL such as Sulfo EPDM, as covered in U.S. Pat. No. 4,379,914 issued 4/12/83.

(2) Interaction of the amine terminated PCL with a suitable metal neutralized Sulfonated polymer such as zinc sulfonated EPDM. We find that these complexes are especially suited for the instant invention, especially those employing the zinc counter ion. The latter class of materials is especially effective as wax crystal modifiers.

SUMMARY OF THE INVENTION

A family of polymers based on amine terminated polylactones is interacted with a carboxylic or sulfonic acid or ionomer derived therefrom to create a complex or neutralized species. The resulting adduct is useful as a pour depressant agent which is very effective in promoting flow of heating fuels, diesel, and paraffinic oils at extremely low temperatures.

The pour depressant agent of the instant invention are polymer adducts which are based on the chemical combination of sulfonated polymers and an amine-terminated polylactone. As such, these polymers can have many of the physical properties of the base sulfonated polymer (such as Sulfo EPDM) but also derive many of the desirable features of the polylactone (such as poly-ε-caprolactone). Generally, the sulfonated polymer and the lactone polymer are not truly molecularly compatible and, therefore, are phase separated. Due to the fact that the sulfonated polymer is chemically combined with a novel class of amine terminated lactones, such as described in U.S. Pat. No. 4,379,914, the resulting grafted polymer system displays some properties of both polymer phases.

This invention relates to unique and novel pour depressant agents based on chemically combining a sulfonated polymer and a tertiary amine terminated polylactone composition.

It is clear from the previous discussion that the combination of a sulfonic acid or carboxylic acid containing hydrocarbon polymer can be interacted with an amine terminated polylactone to form an acid-base adduct. The instant invention also encompasses a second type of polymer adduct, that of a neutralized sulfonate ionomer which is complexed with the amine terminated polylactone. The composition and nature of these novel systems is described in a copending application Ser. No. 566,347.

The metal neutralized sulfonated ionomers have been described in a number of issued and pending patents. There are specific requirements for the instant invention as follows:

The degree of neutralization of said ionomeric groups may vary from 50 to 500 mole %, preferably 90 to 200%. It is preferred that the degree of neutralization be substantially complete, that is, with no substantial free acid present and without substantial excess of the base other than that needed to ensure neutralization.

We have surprisingly found that a very important factor in determining the strength of the interaction between the amine-containing polymer and the sulfonate-containing polymer is the nature of the counterion. There are, broadly speaking, two major classes of such counterions. The first class, which are less preferred, are those metals of Group I and Group IIA, which include Li, Na, K, etc., Be, Mg, Ca, etc. We have found that these species do not interact as strongly with amine groups as the more preferred species described below. The second class of metals are commonly defined as members of the transition elements (see chemical text: "Chemical Principles and Properties", by M. J. Sienko and R. A. Plane, McGraw Hill Book Co., 1974, page 19). These metal cations are best exemplified by zinc and interact strongly with pyridine and similar amines. As a consequence, a zinc neutralized sulfonated polymer interacts much more strongly with an amine terminated polylactone than does a magnesium or sodium neutralized system. It is for this reason that the transition elements are preferred with zinc, copper, iron, nickel and cobalt being especially preferred. We also include antimony and lead as suitable cations.

It is an object of the present invention to set forth an improved process for the manufacture of very effective pour depressants for middle distillates and lighter oils. In general, these oils boil in the range from about 140° F. to 400° F.

It is another object of the present invention to provide heating oils, diesel fuel oils, kerosenes and jet fuels having low pour points. Aviation turbo-jet fuels in which the polymers may be used normally boil between 140° F. and about 290° C. for civilian aircraft.

Another object of this invention to set forth an improved pour depressant for middle distillate and lighter fuels. The boiling ranges of these oils are generally about 140° to 400° C.

The neutralized sulfonated elastomeric polymers of this present invention are derived from elastomeric or thermoplastic polymers wherein the elastomeric polymers are derived from unsaturated polymers which include low unsaturated elastomeric polymers such as Butyl rubbers or EPDM terpolymers.

Alternatively, other unsaturated polymers are selected from the group consisting of partially hydrogenated polyisoprenes, partially hydrogenated polybutadienes, Neoprene, styrene-butadiene copolymers or isoprene-styrene random copolymers.

The expression "Butyl rubber" as employed in the specification and claims, is intended to include copolymers made from a polymerization reaction mixture having therein from 70 to 99.5% by weight of an isoolefin which has about 4 to 7 carbon atoms, e.g., isobutylene and about 0.5 to 30% by weight of a conjugated multiolefin having from about 4 to 14 carbon atoms, e.g., isoprene. The resulting copolymer contains 85 to 99.8% by weight of combined isoolefin and 0.2 to 15% of combined multiolefin.

Butyl rubber generally has a Staudinger molecular weight as measured by GPC of about 20,000 to about 500,000, preferably about 25,000 to about 400,000 especially about 100,000 to about 400,000 and a Wijs Iodine No. of about 0.5 to 50, preferably 1 to 15. The preparation of Butyl rubber is described in U.S. Pat. No. 2,356,128 which is incorporated herein by reference.

For the purposes of this invention, the Butyl rubber may have incorporated therein from about 0.2 to 10% of combined multiolefin; preferably about 0.5 to about 6%; more preferably, about 1 to about 4%, e.g., 2%.

Illustrative of such a Butyl rubber is Exxon Butyl 365 (Exxon Chemical Co.), having a mole percent unsaturation of about 2.0% and a Mooney viscosity (ML, 1+3. 212° F.) of about 40–50.

Low molecular weight Butyl rubbers, i.e., Butyl rubbers having a viscosity average molecular weight of about 5,000 to 85,000 and a mole percent unsaturation of about 1 to about 5% may be sulfonated to produce the polymers useful in this invention. Preferably, these polymers have a viscosity average molecular weight of about 25,000 to about 60,000.

The EPDM terpolymers are low unsaturated polymers having about 1 to about 10.0 wt.% olefinic unsaturation, more preferably about 2 to about 8, most preferably about 3 to 7 defined according to the definition as found in ASTM-D-1418-64 and is intended to mean terpolymers containing ethylene and propylene in the backbone and a diene in the side chain. Illustrative methods for producing these terpolymers are found in U.S. Pat. No. 3,280,082, British Pat. No. 1,030,289 and French Pat. No. 1,386,600, which are incorporated herein by reference. The preferred polymers contain about 40 to about 75 wt.% ethylene and about 1 to about 10 wt.% of a diene monomer, the balance of the polymer being propylene. Preferably, the polymer and about 2.6 to about 8.0 wt.% diene monomer, e.g., 5.0 wt.%. The diene monomer is preferably a nonconjugated diene.

Illustrative of these nonconjugated diene monomers which may be used in the terpolymer (EPDM) are 2,4-hexadiene, dicyclopentadiene, 5-ethylidene-2-norbornene, 5-methylene-2-norbornene, 5-propenyl-2-norbornene, and methyl tetrahydroindene.

A typical EPDM is Vistalon 2504 (Exxon Chemical Co.), a terpolymer having a Mooney viscosity (M1, 1+8, 212°) of about 40 and having an ethylene content of about 50 wt.% and a 5-ethylidene-2-nobornene content of about 5.0 wt.%. The Mn as measured by GPC of Vistalon 2504 is about 47,000, the Mv as measured by GPC is about 145,000 and the Mw as measured by GPC is about 174,000.

Another EPDM terpolymer vistalon 2504-20 is derived from Vistalon 2504 (Exxon Chemical Co.) by a controlled extrusion process, wherein the resultant Mooney viscosity at 212° F. is about 20. The Mn as measured by GPC of Vistalon 2504-20 is about 26,000, the Mv as measured by GPC is about 90,000 and the Mw as measured by GPC is about 125,000.

Nordel 1320 (DuPont) is another terpolymer having a Mooney viscosity at 212° F. of about 25 and having about 53 wt.% of ethylene, about 3.5 wt.% of 1,4-hexadiene, and about 43.5 wt.% of 1,4-hexadiene, and about 43.5 wt.% of propylene.

The EPDM terpolymers of this invention have a number average molecular weight (Mn) as measured by GPC of about 10,000 to about 200,000 more preferably of about 15,000 to about 100,000, most preferably, of about 20,000 to about 60,000. The Mooney viscosity (ML, 1+8, 212° F.) of the EPDM terpolymer is about 5 to about 60, more preferably, about 10 to about 50, most preferably, about 15 to about 40. The Mv as measred by GPC of the EPDM terpolymer is preferably below about 350,000 and, more preferably, below about 300,000. The Mw as measured by GPC of the EPDM terpolymer is preferably below about 500,000 and, more preferably, below about 350,000.

The neutralized sulfonated thermoplastic polymers of the instant invention are derived from polystyrene type thermoplastics polymers which are selected from the group consisting of polystyrene, poly-t-butyl, styrene, polychlorostyrene, polyalpha methyl styrene and co- or terpolymers of the aforementioned with acrylonitrile or vinyl toluene.

The polystyrene thermoplastics suitable for use in the practice of the invention have a glass transition temperature from about 90° C. to about 150° more preferably, about 90° C. to about 140° C. and, most preferably, about 90° C. to about 120° C. These polystyrene resins have a weight average molecular weight as measured by GPC of about 5,000 to about 500,000, more preferably, about 20,000 to about 350,000 and, most preferably, about 90,000 to about 300,000. These base polystyrene thermoplastic resins can be prepared directly by any of the known polymerization processes. The term "thermoplastic" is used in its conventional sense to mean a substantially rigid (flexus modulus 10,000 psi) material capable of retaining the ability to flow at elevated temperatures for relatively long times.

The preferred polystyrene thermoplastic resin is a homopolymer of styrene having a number average molecular weight of about 180,000, and an intrinsic viscosity in toluene of about 0.8. These polymers are widely available commercially in large volume. A suitable material is Styron 666 which affords a number average molecular weight (Mn) of about 105,000.

In carrying out the invention, the polymer is dissolved in a nonreactive solvent such as a chlorinated aliphatic solvent, chlorinated aromatic hydrocarbon, an aromatic hydrocarbon, or an aliphatic hydrocarbon such as carbon tetrachloride, dichloroethane, chlorobenzene, benzene, toluene, xylene, cyclohexane, pentane, isopentane, hexane, isohexane or heptane. The preferred solvents are the lower boiling aliphatic hydrocarbons. A sulfonating agent is added to the solution of the elastomeric polymer and nonreactive solvent at a temperature of about −100° C. to about 100° C. for a period of time of about 1 to about 60 minutes, more preferably, at room temperature for about 5 to about 45 minutes; and, most preferably, about 15 to about 30. Typical sulfonating agents are described in U.S. Pat. Nos. 3,642,728 and 3,836,511, previously incorporated herein by reference. These sulfonating agents are selected from an acyl sulfate, a mixture of sulfuric acid and an acid anhydride of a complex of a sulfur trioxide donor and a Lewis base containing oxygen, sulfur, or phosphorous. Typical sulfur trioxide donors are $SO_3$, chlorosulfonic acid, fluorosulfonic acid, sulfuric acid, oleum, etc. Typical Lewis bases are: dioxane, tetrahydrofuran, tetrahydrothiophene or triethyl phosphate. The most preferred sulfonation agent for this invention is an acyl sulfate selected from the group consisting essentially of benzoyl, acetyl, propionyl or butyryl sulfate. The acyl sulfate can be formed in situ in the reaction medium or pregenerated before its addition to the reaction medium in a chlorinated aliphatic or aromatic.

It should be pointed out that neither the sulfonating agent nor the manner of sulfonation is critical, provided that the sulfonating method does not degrade the polymer backbone. The reaction is quenched with an aliphatic alcohol such as methanol, ethanol or isopropanol, with an aromatic hydroxyl compound, such as phenol, a cycloaliphatic alcohol such as cyclohexanol or with water. The unneutralized sulfonated elastomeric polymer has about 5 to about 100 meq unneutralized sulfonate groups per 100 grams of sulfonated polymer, more preferably, about 10 to about 100; and most preferably, about 10 to about 50. The meq. of unneutralized sulfonate groups per 100 grams of polymer is determined by both titration of the polymeric sulfionic acid and Dietert Sulfur analysis. In the titration of the sulfonic acid, the polymer is dissolved in solvent consisting of 95 parts of toluene and 5 parts of methanol at a concentration level of 50 grams per liter of solvent. The unneutralized form is titrated with ethanolic sodium hydroxide to an Alizarin Thymolphthalein endpoint.

The unnuetralized sulfonated polymer is gel free and hydrolytically stable. Gel is measured by stirring a given weight of polymer in a solvent comprised of 95 toluene-5-methanol at a concentration of 5 wt.%, for 24 hours, allowing the mixture to settle, withdrawing a weighed sample of the supernatant solution and evaporating to dryness.

Hydrolytically stable means that the acid function, in this case the sulfonic acid, will not be eliminated under neutral or slightly basic conditions to a neutral moiety which is incapable of being converted to highly ionic functionality.

Neutralization of the unneutralized sulfonated polymer is done by the addition of a solution of a polycaprolactone polymer to the unneutralized sulfonated elastomeric polymer typically dissolved in the mixture of the aliphatic alcohol and nonreactive solvent. The polycaprolactone polymer is dissolved in a solvent system consisting of toluene, optionally containing an aliphatic alcohol. These polycaprolactone polymers are formed by the reaction of ϵ-caprolactcne with an organic diamine in the presence of a catalyst as described in a copending application. The anhydrous ϵ-caprolactone and the organic diamine in the presence of the catalyst are reacted together in a reaction vessel in the absence of a solvent at a temperature of about 50° to about 200° C., more preferably, about 75° to about 180° C. and, most preferably, about 90° to about 150° C. for a sufficient period of time to effect polymerization.

The reaction of the ϵ-caprolactone with the diamine can be generally depicted by the equation. wherein n=1 to 500, m=1 to 20, $R_1$ or $R_2$ are selected from the group consisting of alkyl, heterocyclic cycloalkyl and aromatic groups having about 1 to about 20 carbon atoms, more preferably, about 1 to about 12 carbon atoms, and aryl groups, and $R_3$ is selected from the group consisting of hydrogen, alkyl and cycloalkyl groups having about 1 to about 20 carbon atoms, more preferably about 1 to about 20 carbon atoms, more preferably about 1 to about 12, and aryl groups and $R_4$ and $R_5$ are hydrogen, alkyl, cycloalkyl or aryl groups. Typical, but nonlimiting, examples of useful diamines are:

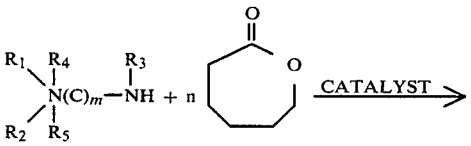

ϵ-CAPROLACTONE

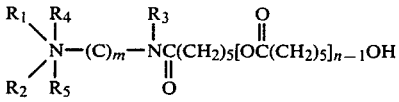

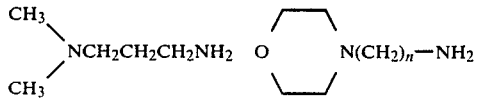

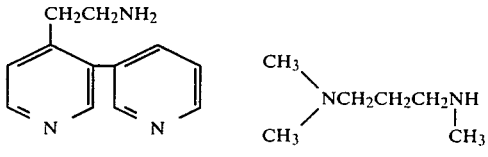

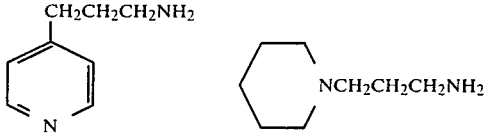

-continued

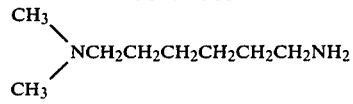

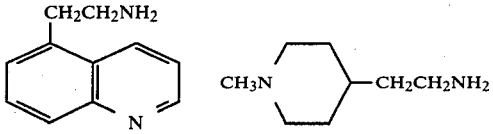

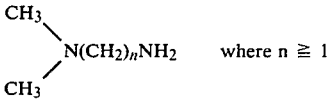

where n ≧ 1

Catalysts useful in the promotion of the above-identified reaction are selected from the group consisting of stannous octanoate, stannous hexanoate, stannous oxalate, tetrabutyl titanate, a variety of metal organic based catalysts, acid catalysts and amine catalysts, as described on page 266, and forwarded in a book chapter authored by R. D. Lundberg and E. F. Cox, entitled Kinetics and Mechanisms of Polymerization: Ring Opening Polymerization; edited by Frisch and Rugen, published by Marcell Dekker in 1969, wherein stannous octanoate is an especially preferred catalyst. The catalyst is added to the reaction mixture at a concentration level of about 100 to about 10,000 parts of catalyst per 1 million parts of ϵ-carpolactone.

The resultant polycaprolactone polymer has an Mn as measured by GPC of about 200 to about 50,000, more preferably about 500 to about 40,000, and, most preferably, about 700 to about 30,000 and a melting point from below room temperature to about 55° C., more preferably about 20° C. to about 52° C., and most preferably, about 20° C. to about 50° C.

Alternatively to neutralizing the unneutralized sulfonated polymer with the amine terminated polycaprolactone polymer, one can first neutralize the unneutralized sulfonated polymer with an ammonium or metal counterion selected from the group consisting of Groups IA, IB, IIA and IIB or Periodic Table of Elements, wherein the zinc counterion is preferred, and subsequently reacting the amine terminated polycaprolactone polymer with the neutralized sulfonated polymer.

The polymer compositions prepared according to this invention cover a variety of new systems and applications. For example, Sulfo EPDM neutralized with tertiary amine terminated poly-ϵ-carpolactone can possess a variety of properties depending on sulfonic acid content and poly-ϵ-caprolactone (PCL) molecular weight. Thus, a high molecular weight PCL (for example, a number average molecular weight of 10,000) coupled with Sulfo EPDM of 30 milliequivalents per 100 grams sulfonic acid content would require about 300 grams of PCL per 100 grams of Sulfo EPDM to effect neutralization. Such a composition, therefore, would be about 75 percent PCL. On the other hand, the use of a PCL polymer of 1,000 molecular weight would result in a neutralized graft ionomer of about 23 percent PCL. The properties of these two compositions will obviously vary substantially, depending on the compositions.

Similarly, sulfonated polystyrene (S-PS) can be neutralized with PCL. In this case, polystyrene can be sulfonated over a range of sulfonic acid contents from as little as 1 mole percent up to about 100 mole percent. In the former case, only 1 of every 100 repeat units contains sulfonic acid groups, while in the latter case, every aromatic group is sulfonated. Obviously, the range of compositions available, depending on the PCL molecular weight or the sulfonic acid content, is extremely large. The variation in physical properties available, similarly, is large.

Other types of polymer sulfonic acids suitable in this invention include sulfonated polybutadiene, sulfonated polyisoprene, sulfonated Butyl, sulfonated SBR, sulfonated polypentenomer, etc. Of special interest are polymers with terminal unsaturation such as polyisobutylene. Typically, this polymer is terminated with an olefin group which can be sulfonated to provide a long chain polyisobutylene of from 500 to 25,000 in molecular weight. Sulfonation of this functionality provides a polymer with a sulfonic acid group at just one end, and which can then be neutralized to provide a polyisobutylene/PCL block copolymer composed of just two blocks.

The polymer adduct of the amine terminated polycaprolactone and the neutralized or unneutralized sulfonated polymers are effective pour depressant agents for middle distillates and lighter oils having a boiling point range of about 140° F. to 400° F. These polymer adducts are also useful as pour depressant agents for heating oils, diesel fuel oils, kerosenes and jet fuels having low pour points. Aviation turbo-jet fuels in which the polymer adduct may be used normally boil between about 240° to about 290° C. Diesel fuels as referred to in connection with the invention consist of at least 95% of a mixture of hydrocarbons boiling between 250° F. and 75° F. The liquid fuels in which the additive materials may be incorporated thus comprise at least 95% by weight of a mixture of hydrocarbons having a boiling range between the limits of 25° C. and 400° C. and a viscosity between the limits of 10 and 400 centistokes at 18° C. The concentration of the polymer adduct as a pour depressant agent in the oil or fuel is about 25 parts per million to about 1.0 wt.% of the fuel or oil.

DETAILED DESCRIPTION OF THE INVENTION

The advantages of the polymer adducts of the instant invention as pour depressant agents can be more readily appreciated by reference to the following examples and tables.

EXAMPLE 1

A sample of Sulfo EPDM (zinc salt, 20 meq/200 g of sulfonic acid content designated TP 319) was interacted with an amine terminated polycaprolactone (A-PCL) of 3,000 molecular weight such that 1.5 gm of A-PCL was added to 5 g of Sulfo EPDM in a melt blending operation on a 2 roll mill. The blend was dissolved at 2% in heptane and aliquots of the heptane solution added to a paraffinic motor oil (100N). Levels of active agent of 20,100, and 1000 ppm were explored. The results are shown in Table I.

TABLE I

Effect of Temperature. Addition of SEPDM-PCL Amine Blend (Heptane Solution)* to 100N oil cooled at −25° C.

| Sample | Additive | Additive Level | Observation at −20° C. |
|---|---|---|---|
| 2A | TP319-PCLA in heptane | 1000 ppm | Flows |
| 2B | TP319-PCLA in heptane | 100 ppm | Flows |

TABLE I-continued

Effect of Temperature. Addition of SEPDM-PCL Amine Blend (Heptane Solution)* to 100N oil cooled at −25° C.

| Sample | Additive | Additive Level | Observation at −20° C. |
|---|---|---|---|
| 2E | TP319-PCLA in heptane | 20 ppm | No flow |
| 2C | Heptane-same level as 1000 ppm (2.5 ml) | 0 | Very slow flow |
| 2D | Heptane-same level as 100 ppm (0.25 ml) | 0 | No flow |
| 2F | Heptane-same level as 20 ppm (0.05 ml) | 0 | No flow |

*2% conc. 155-2 blend (5 gm, TP319, 20 meq, Zn + 1.5 g PCL Amine) in heptane.

EXAMPLE 2

The heptane solution of Example 1 was also added to diesel 260. The results are shown in Table II.

TABLE II

Effect of Temperature. Addition of S-EPDM-PCL Amine (heptane solution)* to diesel (cooled at −25° C.)

| Sample | Additive | Additive Level | Observation at −25° C. |
|---|---|---|---|
| 2G | TP319-PClA in heptane | 1000 ppm | Fast flow, liquid |
| 2H | TP319-PCLA in heptane | 100 ppm | Slow flow, loose mush |
| 2K | TP319-PCLA in heptane | 20 ppm | Solid mush |
| 2I | Heptane-same level as 1000 ppm (2.5 ml) | 0 | Loose mush |
| 2J | Heptane-same level as 100 ppm (0.25 ml) | 0 | Solid mush |
| 2L | Heptane-same level as 20 ppm (0.05 ml) | 0 | Solid mush |
| Diesel | — | — | Solid mush |

The Sulfo EPDM was interacted with A-PCL at a higher level (2.25 gms per 5 gms of Sulfo EPDM). A series of controls were also run including unsulfonated EPDM, amine terminated poly ϵ-caprolactone, and a sample of polycaprolactone of 10,000 molecular weight commercially available but not terminated with amine (PCL-300). These systems were also added to 100N oil at levels of 20, 100, and 1000 ppm as shown in Table III.

In all cases the complex of A-PCL and Sulfo-EPDM resulted in a marked improvement in the mobility of the 100N oil in the diesel, in some cases resulting in a free flowing fluid at temperatures of −25° C. even after 18 hours storage.

TABLE III

Effect of Temperature. 100N Oil with Noted Additives cooled at −25° C.

| Sample | Additive | Additive Level | Observation at −25° C. |
|---|---|---|---|
| 6-100N | (100N oil control) | 0 | Solid |
| 5A | EPDM | 1000 ppm | Solid |
| 5B | PCL Amine | 1000 ppm | Solid |
| 5C | TP319-PCL 300 (5/1.5) | 1000 ppm | Solid |
| 6A-1 | TP319-PCLA (5/2.25) | 1000 ppm | Flows |
| 6A-2 | TP319-PCLA (5/2.25) | 100 ppm | Flows |
| 6A-3 | TP319-PCLA (5/2.25) | 20 ppm | Solid |
| 6B-1 | TP319-PClA (5/1.5) | 100 ppm | Flows |
| 6B-2 | TP319-PCLA (5/1.5) | 100 ppm | Flows |
| 6B-3 | TP319-PCLA (5/1.5) | 20 ppm | Solid |

(1) EPDM control
(2) Polycaprolactone amine
(3) Mill blended 5 g TP319 + 1.5 g PCL 300, sample of poly caprolactone available from Union Carbide without terminal amine group.
(4) Mill blended 5 g TP319 + 2.25 g PCL Amine
(5) Mill blended 5 g TP319 + 1.5 g PCL Amine Since many modifications and variations of this invention may be made without departing from the spirit or scope of the invention thereof, it is not intended to limit the spirit or scope thereof to the specific examples thereof.

What is claimed is:

1. A process for decreasing the pour point of hydrocarbon oils and fuels which comprises adding about 25 parts per million to about 1.0 weight percent of said oil or said fuel of a sulfonated polymer to said fuel or said oil, said sulfonated polymer having about 5 to about 100 meq. of sulfonate groups per 100 grams of said sulfonated polymer, said sulfonate groups being neutralized with a polycaprolactone polymer having the formula:

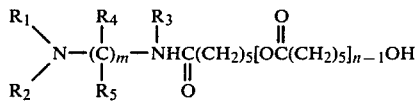

wherein $R_1$ or $R_2$ is an alkyl, cycloalkyl heterocyclic or aryl group, $R_3$, $R_4$ and $R_5$ are a hydrogen or alkyl, cycloalkyl, or aryl groups, m equals 1 to 20 and n equals 1 to about 500.

2. A process according to claim 1 wherein $R_1$ and $R_2$ are an alkyl group and $R_3$ is hydrogen.

3. A process according to claim 1 wherein either $R_1$ or $R_2$ is a methyl groups and $R_3$ is hydrogen.

4. A process according to claim 1 wherein $R_1$ and $R_2$ are both methyl groups and $R_3$ is hydrogen.

5. A process process according to claim 1 wherein $R_1$, $R_2$, and $R_3$ are methyl groups.

6. A process according to claim 1 wherein $R_1$ and $R_2$ comprise components of a cyclic structure including multiring or heterocyclic rings.

7. A process according to claim 1 wherein said neutralized sulfonated polymer is formed from an elastomeric polymer selected from the group consisting of Butyl rubber and an EPDM terpolymer.

8. A process for decreasing the pour point of hydrocarbon oils and fuels which comprises adding about 25 parts per million to about 1.0 weight percent of said fuel or said oil of a pour depressant agent, said pour depressant agent being the reaction product of a neutralized sulfonated polymer and a polycaprolactone polymer, said neutralized sulfonated polymer having about 5 to about 100 meq. of neutralized sulfonate groups per 100 grams of said sulfonated polymer and said polycaprolactone polymer having the formula;

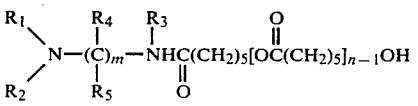

wherein $R_1$ or $R_2$ is an alkyl, cycloalkyl or aryl group, $R_3$, $R_4$ and $R_5$ are a hydrogen or alkyl, cycloalkyl, or aryl groups, m equals 1 to 20 and n equals about 1 to about 500.

9. A process according to claim 8 wherein $R_1$ and $R_2$ are an alkyl group and $R_3$ is hydrogen.

10. A process according to claim 8 wherein either $R_1$ or $R_2$ is a methyl group and $R_3$ is hydrogen.

11. A process according to claim 8 wherein $R_1$ and $R_2$ are both methyl groups and $R_3$ is hydrogen.

12. A process according to claim 8 wherein $R_1$, $R_2$, and $R_3$ are methyl groups.

13. A process according to claim 1 wherein said neutralized sulfonated polymer is formed from an elastomeric polymer selected from the group consisting of Butyl rubber and an EPDM terpolymer.

14. A process for decreasing the pour point of hydrocarbon fuels and oils which comprises adding about 25 parts per million to about 1.0 weight percent of a metal neutralized sulfonated polymer to said oil or fuel, said metal neutralized polymer having about 5 to about 100 meq of sulfonate groups per 100 grams of polymer, said metal sulfonate groups being complexed with a polycaprolactone polymer having the formula:

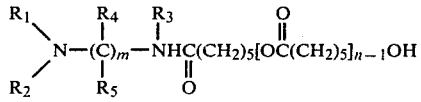

wherein $R_1$ or $R_2$ is an alkyl, cycloalkyl heterocyclic or aryl group, $R_3$, $R_4$ and $R_5$ are a hydrogen or alkyl, cycloalkyl, or aryl groups, m equals 1 to 20 and n equals about 1 to about 500 and where the metal is one of the transition metals especially including zinc, copper, iron, nickel, cobalt.

15. A process according to claim 14 wherein $R_1$ and $R_2$ are an alkyl group and $R_3$ is hydrogen.

16. A process according to claim 14 wherein either $R_1$ or $R_2$ is a methyl group and $R_3$ is hydrogen.

17. A process according to claim 14 wherein $R_1$ and $R_2$ are both methyl groups and $R_3$ is hydrogen.

18. A process according to claim 14 wherein $R_1$, $R_2$, and $R_3$ are methyl groups.

19. A process according to claim 14 where $R_1$ and $R_2$ comprise components of a cyclic structure including multiring or heterocyclic rings.

20. A process according to claim 14 wherein said metal neutralized sulfonated polymer is formed from an elastomeric polymer selected from the group consisting of Butyl rubber and an EPDM terpolymer and the metal is zinc.

21. A solution which comprises:

(a) a hydrocarbon oil or fuel; and (b) about 20 to about 10,000 ppm of a polymer sulfonic acid which has about 5 to about 100 meq. of sulfonate groups per 100 grams of said sulfonated polymer, said sulfonate groups being neutralized with a polycaprolactone polymer having the formula:

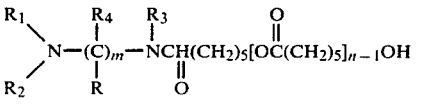

wherein $R_1$ or $R_2$ is an alkyl, cycloalkyl heterocyclic or aryl group, $R_3$, $R_4$ and $R_5$ are a hydrogen or alkyl, cycloalkyl, or aryl groups m equals 1 to 20 and n equals about 1 to about 500.

22. A solution according to claim 21 wherein $R_1$ and $R_2$ are an alkyl group and $R_3$ is hydrogen.

23. A solution according to claim 21 wherein either $R_1$ or $R_2$ is a methyl group and $R_3$ is hydrogen.

24. A solution according to claim 21 wherein $R_1$ and $R_2$ are both methyl groups and $R_3$ is hydrogen.

25. A solution according to claim 21 wherein $R_1$ $R_2$, and $R_3$ are methyl groups.

26. A solution according to claim 21 where $R_1$ and $R_2$ comprise components of a cyclic structure including multiring or heterocyclic rings.

27. A solution according to claim 21 wherein said neutralized sulfonated polymer is formed from an elastomeric polymer selected from the group consisting of Butyl rubber and an EPDM terpolymer.

28. A solution which comprises:

(a) a hydrocarbon oil or fuel; and (b) about 20 to about 10,000 ppm of a polymer which is the reaction product of a neutralized sulfonated polymer and a polycaprolactone polymer, said neutralized sulfonated polymer having about 5 to about 100 meq. of neutralized sulfonate groups per 100 grams of said sulfonated polymer and said polycaprolactone polymer having the formula:

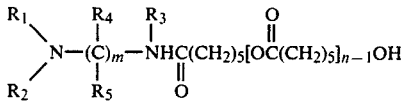

wherein $R_1$ or $R_2$ is an alkyl, cycloalkyl or aryl group, $R_3$, $R_4$ and $R_5$ are a hydrogen or alkyl, cycloalkyl, or aryl groups, m equals 1 to 20 and n equals about 1 to about 500.

29. A solution according to claim 28 wherein $R_1$ and $R_2$ are an alkyl group and $R_3$ is hydrogen.

30. A solution according to claim 28 where either $R_1$ or $R_2$ is a methyl group and $R_3$ is hydrogen.

31. A solution according to claim 28 wherein $R_1$ and $R_2$ are both methyl groups and $R_3$ is hydrogen.

32. A solution according to claim 28 wherein $R_1$, $R_2$, and $R_3$ are methyl groups.

33. A solution according to claim 28 wherein said neutralized sulfonated polymer is formed from an elastomeric polymer selected from the group consisting of Butyl rubber and an EPDM terpolymer.

(a) a hydrocarbon oil or fuel; and (b) about 20 to about 10,000 ppm of a neutralized sulfonated polymer which has about 5 to about 100 meq of sulfonate groups per 100 ppm of polymer, said metal sulfonate groups being complexed with a polycaprolactone polymer having the formula:

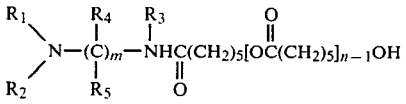

wherein $R_1$ or $R_2$ is an alkyl, cycloalkyl heterocyclic or aryl group, $R_3$ $R_4$ and $R_5$ are a hydrogen of alkyl, cycloalkyl, or aryl groups, m equals 1 to 20 and n equals about 1 to about 500.

34. A solution according to claim 33 wherein $R_1$ and $R_2$ are an alkyl group and $R_3$ is hydrogen.

35. A solution according to claim 34 wherein either $R_1$ or $R_2$ is a methyl group and $R_3$ is hydrogen.

36. A solution according to claim 34 wherein $R_1$, $R_2$, and $R_3$ are methyl groups.

37. A solution according to claim 34 where $R_1$ and $R_2$ comprise components of a cyclic structure including multiring or heterocyclic rings.

38. A solution according to claim 34 wherein said neutralized sulfonated polymer is formed from an elastomeric polymer selected from the group consisting of Butyl rubber and an EPDM terpolymer.

* * * * *